US006124842A

United States Patent [19]

Mizutome et al.

[11] Patent Number: 6,124,842

[45] **Date of Patent: *Sep. 26, 2000**

[54] DISPLAY APPARATUS

[75] Inventors: Atsushi Mizutome, Fujisawa; Hiroshi Inoue, Yokohama, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/312,154

[22] Filed: Sep. 23, 1994

Related U.S. Application Data

[63] Continuation of application No. 08/075,929, Jun. 14, 1993, abandoned, which is a continuation of application No. 07/594,699, Oct. 9, 1990, abandoned.

[30] Foreign Application Priority Data

Oct. 6, 1989 [JP] Japan ..... 1-261297

[51] Int. Cl.[7] ..... G09G 5/00

[52] U.S. Cl. ..... 345/132; 345/516

[58] Field of Search ..... 382/47; 345/186, 345/199, 200, 94, 149, 132, 516; 395/128, 134

[56] References Cited

U.S. PATENT DOCUMENTS

| | | | |
|---|---|---|---|
| 4,536,856 | 8/1985 | Hiroishi | 340/784 |
| 4,615,919 | 10/1986 | Inoue et al. | 428/1 |
| 4,714,921 | 12/1987 | Kanno et al. | 340/784 |
| 4,724,433 | 2/1988 | Inoue et al. | 340/805 |
| 4,779,085 | 10/1988 | Mizutome et al. | 340/805 |
| 4,779,086 | 10/1988 | Kanno et al. | 340/805 |
| 4,795,239 | 1/1989 | Yamashita et al. | 350/333 |
| 4,821,208 | 4/1989 | Ryan et al. | 340/799 |
| 4,830,467 | 5/1989 | Inoue et al. | 350/333 |
| 4,922,241 | 5/1990 | Inoue et al. | 340/784 |
| 4,930,875 | 6/1990 | Inoue et al. | 350/333 |
| 4,952,032 | 8/1990 | Inoue et al. | 350/350 S |
| 4,964,699 | 10/1990 | Inoue | 350/332 |
| 4,977,398 | 12/1990 | Pleva et al. | 340/793 |
| 4,990,902 | 2/1991 | Zenda | 340/771 |
| 4,990,904 | 2/1991 | Zenda | 340/771 |
| 5,091,723 | 2/1992 | Kanno et al. | 345/94 |
| 5,119,082 | 6/1992 | Lumelsky et al. | 345/132 |
| 5,142,616 | 8/1992 | Kellas et al. | 395/128 |
| 5,321,419 | 6/1994 | Katakura et al. | 345/97 |
| 5,430,832 | 7/1995 | Imaizumi et al. | 395/134 |

FOREIGN PATENT DOCUMENTS

| | | | |
|---|---|---|---|
| 0195203 | 9/1986 | European Pat. Off. . | |
| 0295691 | 12/1988 | European Pat. Off. . | |
| 61-212184 | 9/1986 | Japan | H04N 9/78 |
| 63-285141 | 11/1988 | Japan | C04B 24/26 |

OTHER PUBLICATIONS

Mueller, Scott, "Upgrading and Repairing PCs", Que Corp., 1988, pp. 442–443.

Pat. Abs. vol. 10, No. 232, Aug. 12, 1986 and JP–A–61–067024.

*Primary Examiner*—Amare Mengistu

*Attorney, Agent, or Firm*—Fitzpatrick, Cella, Harper & Scinto

[57] ABSTRACT

There is provided a display apparatus which uses a display panel using a liquid crystal having a bistability or a memory performance such as a ferroelectric liquid crystal and can display image data in various display modes in which the number of pixels (resolution), display color, minimum pixel unit, and the like respectively differ. The display apparatus comprises: a memory to store the image data; a pixel data output circuit to output the image data stored in the memory every pixel data; a converter to convert the pixel data which was output from the pixel data output circuit into binary data which is displayed on the display panel; a display data output circuit for converting the binary data converted by the converter into the display data corresponding to the display mode and outputting; and a display controller for allowing the image data which was output by the display data output circuit to be displayed on the display panel. A multiplexer is used as a pixel data output circuit. An RAM in which binary data has been stored is used as a converter.

14 Claims, 10 Drawing Sheets

FIG. 3

PIXEL MULTIPLEXER 11 CONVERSION MODE

| MODE | PHASE | INPUT (VRAM DATA) | | OUTPUT (PALETTE ADRS) |
|---|---|---|---|---|
| A | 1 | VSD 0~7 | → | Q 0~7 [8BITS/PIXEL] |
| | | VSD 8~15 | | Q 8~15 |
| B | 1 | VSD 0~3 | | Q 0~3 [4BITS/PIXEL] |
| | | VSD 4~7 | | Q 8~11 |
| | 2 | VSD 8~11 | | Q 0~3 |
| | | VSD 12~15 | | Q 8~11 |
| C | 1 | VSD 0~1 | | Q 0~1 [2BITS/PIXEL] |
| | | VSD 2~3 | | Q 8~9 |
| | 2 | VSD 4~5 | | Q 0~1 |
| | | VSD 6~7 | | Q 8~9 |
| | 3 | VSD 8~9 | | Q 0~1 |
| | | VSD 10~11 | | Q 8~9 |
| | 4 | VSD 12~13 | | Q 0~1 |
| | | VSD 14~15 | | Q 8~9 |

FIG. 6

PIXEL MULTIPLEXER 14 CONVERSION MODE

| MODE | PHASE | INPUT (PALETTE DATA) | | OUTPUT (PIXEL ON/OFF) | |
|---|---|---|---|---|---|
| A | 1 | PL 0~7 | → | PD 0~7 | [4X MODE] |
| | 2 | PH 0~7 | | PD 0~7 | |
| B | 1 | PL 0~3 | | PD 0~3 | [2X MODE] |
| | | PH 0~3 | | PD 4~7 | |
| C | 1 | PL 0~1 | | PD 0~1 | [1X MODE] |
| | | PH 0~1 | | PD 2~3 | |
| | 2 | PL 0~1 | | PD 4~5 | |
| | | PH 0~1 | | PD 6~7 | |

EXAMPLE 1

EXAMPLE 2

(HL) : HORIZONTAL LEFT
(HR) : HORIZONTAL RIGHT
(VU) : VERTICAL UPPER
(VL) : VERTICAL LOWER

FIG. 10A

ALPHANUMERIC MODE

| MODE | NO OF PIXELS | COLOR | BITS/PIXEL |
|---|---|---|---|
| 0, 1 | 320×200 | 16 | 4 |
| 0*, 1* | 320×350 | 16 | 4 |
| 0+, 1+ | 320×400 | 16 | 4 |
| 2, 3 | 640×200 | 16 | 4 |
| 2*, 3* | 640×350 | 16 | 4 |
| 2+, 3+ | 720×400 | 16 | 4 |
| 7* | 720×350 | mono | 1 |
| 7+ | 720×400 | mono | 1 |

FIG. 10B

GRAPHICS MODE

| MODE | NO OF PIXELS | COLOR | BITS/PIXEL |
|---|---|---|---|
| 4, 5 | 320×200 | 4 | 2 |
| 6 | 640×200 | 2 | 1 |
| D | 320×200 | 16 | 4 |
| E | 640×200 | 16 | 4 |
| F | 640×350 | 4 | 2 |
| 10 | 640×350 | 16 | 4 |
| 11 | 640×480 | 2 | 1 |
| 12 | 640×480 | 16 | 4 |
| 13 | 320×200 | 256 | 8 |

DISPLAY APPARATUS

This application is a continuation of application Ser. No. 08/075,929 filed Jun. 14, 1993, now abandoned, which is a continuation of application Ser. No. 07/594,699 filed Oct. 9, 1990, now abandoned.

BACKGROUND OF THE INVENTION

1. Field of the Invention

The present invention relates to a display apparatus and, more particularly, to an output circuit for image information which is suitable for application to a display apparatus using a binary display element such as a ferroelectric liquid crystal display element or the like having a bistability (memory performance) characteristic for an electric field.

2. Related Background Art

Recently, in displays of personal computers, work stations, and the like, realization of a large display screen and a high resolution is rapidly being progressed. Many display modes including the conventional display modes exist. When explaining an example for a graphics environment of a personal computer made of IBM (trade name: International Business Machines Corporation) which is generally frequently used, there are at least ten kinds of display modes such as CGA (Color Graphic Adapter), EGA (Enhanced Graphic Adapter), VGA (Video Graphic Adapter), and the like. The resolutions and the numbers of colors which can be displayed in those display modes are different in accordance with the display mode;

FIGS. 10A–10B show a list of the above modes and their respective characteristics.

(1) With Respect to the Display Color

As will be understood from FIGS. 10A and 10B, the number of constructing bits per pixel (bits/pixel) differs for every display mode. Also storage formats in respective image memories (VRAM) also differ. Apparently, in the mode in which the number of constructing bits per pixel is large, the multi-color display can be executed.

Explanation will now be made as an example with respect to the display mode 13(h) (VGA) which can perform the highest multi-color display in the graphics environment of the personal computer made by IBM Corporation. An output flow of color information is as follows. First, when a certain address in a VRAM is accessed, the image data (bits/pixel: mode 13(h)) in a VRAM functions as an address to select a color register in a color palette in which color information has previously been stored. In the case of the VGA, the color palette has 256 color registers of 18 bits (6 bits for each of R, G, and B). The color information has been stored in the color registers. When one of the 256 color registers is selected by image data from the VRAM, the color data of R, G, and B each comprising six bits are read out and are processed by D/A converters in the same color palette. One D/A converter is provided for each of R, G, and B and converts the 6-bit color data into the analog signal and sends to a display (CRT).

The output method of the color information (color palette + analog output) as mentioned above has advantages such that: the multi-color display can be realized although a data amount of the VRAM is not so large; the color on the display screen can be changed by rewriting the data of the color registers without needing to rewrite the data in the VRAM; the number of lines connected to the display can be reduced; and the like. Therefore, the above method is mainly a standard method in the present personal computers.

(2) With Respect to the Resolution

In FIGS. 10A and 10B, the resolution also differs for every display mode. For instance, the resolution is set to 320×200 pixels (picture elements) in the case of the mode D(h) and is set to 640×480 pixels in the case of the mode 12(h). Such a method whereby all kinds of display modes are supported by one display (CRT) is hitherto considered to be relatively difficult. In general, the display modes which can display are restricted (limited). On the other hand, in partial CRTs of the automatic tracking type or the like called "multiscan" and "multisync", a method whereby the scanning frequency of an electron beam is switched in accordance with each display mode is used to support the display modes in a relatively wide range. Therefore, if the display is executed in a display mode of small amount of display information (low resolution), the number of characters or numerals which are displayed as rough images is large.

Different from the case of displaying by the CRT or the like, the following points must be considered in the case where various kinds of display modes of different display colors and resolutions are applied to a display apparatus using a liquid crystal, such as a ferroelectric liquid crystal or the like having the memory performance and color information is displayed.

(1) With Respect to the Display Color

In the case of a display apparatus using a binary display element represented by a ferroelectric liquid crystal display apparatus or the like, it is difficult to express gradations (in the depth direction) in an analogwise manner in one pixel (picture element) like a CRT or the like, that is, to three-dimensionally execute a gradation display. In the case of executing the gradation display by the binary display element, in general, a process such that the gradation (color) data in the depth direction is developed in the lateral direction (extending direction) is executed and the color information is two-dimensionally displayed (area gradation). Therefore, in the case where color information is displayed by the ferroelectric liquid crystal display apparatus or the like in various display modes of different display colors, the gradation (color) data in the depth direction which is inherently used for the CRT must be converted into the gradation data in the lateral direction (extending direction) in accordance with the arrangement of the pixels of the actual display apparatus in accordance with the display mode.

(2) With Respect to the Resolution

In the case where the display is executed in various display modes which have conventionally been used in the CRT or the like by using a display apparatus such as a ferroelectric liquid crystal display apparatus or the like of a high resolution (1000×1000 pixels or more), the redundant pixels (the pixels remain) occur on the side of the liquid crystal display apparatus because the resolution in the CRT display mode is lower (an amount of display information is smaller) than the effective number of pixels (resolution) of the liquid crystal display apparatus. In such a case, the enlarged display can be also executed by simultaneously driving a plurality of electrodes in the vertical and lateral directions in a lump on the side of the liquid crystal display apparatus. For instance, in the case of displaying the screen in the mode D(h) (320×200 pixels) by the ferroelectric liquid crystal display apparatus of 1280×1024 pixels or the like, the enlarged display from one time to four times can be realized. Even if such an enlarged display is used, redundant pixels also occur in the portion out of the effective display area depending on the relation between the number of effective pixels (resolution) of the liquid crystal display apparatus and the resolution in the display mode.

Therefore, it is necessary to execute a proper process to the portion (border portion) of the redundant pixels out of the effective display area.

In the case of displaying in the display mode of a low resolution by the CRT, the portion to which an electron beam is not irradiated is maintained black (dark) by thinning out and by scanning the fluorescent display surface by reducing the scanning frequency of the electron beam. However, in the case of the ferroelectric liquid crystal display apparatus, if no image data is input, a state of the pixel is not assured (bright or dark; on or off). Therefore, it is necessary to also input data into the portion of the redundant pixels and to drive and control.

SUMMARY OF THE INVENTION

The present invention is made to eliminate the foregoing problems which cannot be realized by an image information output circuit which is used in a conventional CRT or the like. It is an object of the invention to realize an image information output circuit for displaying the screens in various display modes which have been used in a conventional CRT or the like onto a display apparatus using a binary display element such as a ferroelectric liquid crystal display apparatus or the like without losing image data.

Another object of the invention is to realize an image information output circuit of a display apparatus using a ferroelectric liquid crystal or the like having a bistability (memory performance), comprising a first multiplexer for leading image data which is read out of an image memory to the next stage every pixel data. Palette RAMs are provided each for outputting pixel data on the basis of the data which is output from the first multiplexer. A second multiplexer converts the pixel data from the palette RAM into an output format to transfer to the display apparatus. A converting process of the image data and a process for an area (frame portion) out of the effective display area are executed in accordance with a display mode request from the main body CPU, thereby making it possible to cope with a number of various display modes.

BRIEF DESCRIPTION OF THE DRAWINGS

FIG. 3 is a diagram showing a data conversion format of a pixel multiplexer 11;

FIG. 6 is a diagram showing a data conversion format of a pixel selector 14;

FIGS. 10A and 10B are a diagram showing display modes in a personal computer made by IBM Corporation.

DETAILED DESCRIPTION OF THE PREFERRED EMBODIMENT

Figure 2:
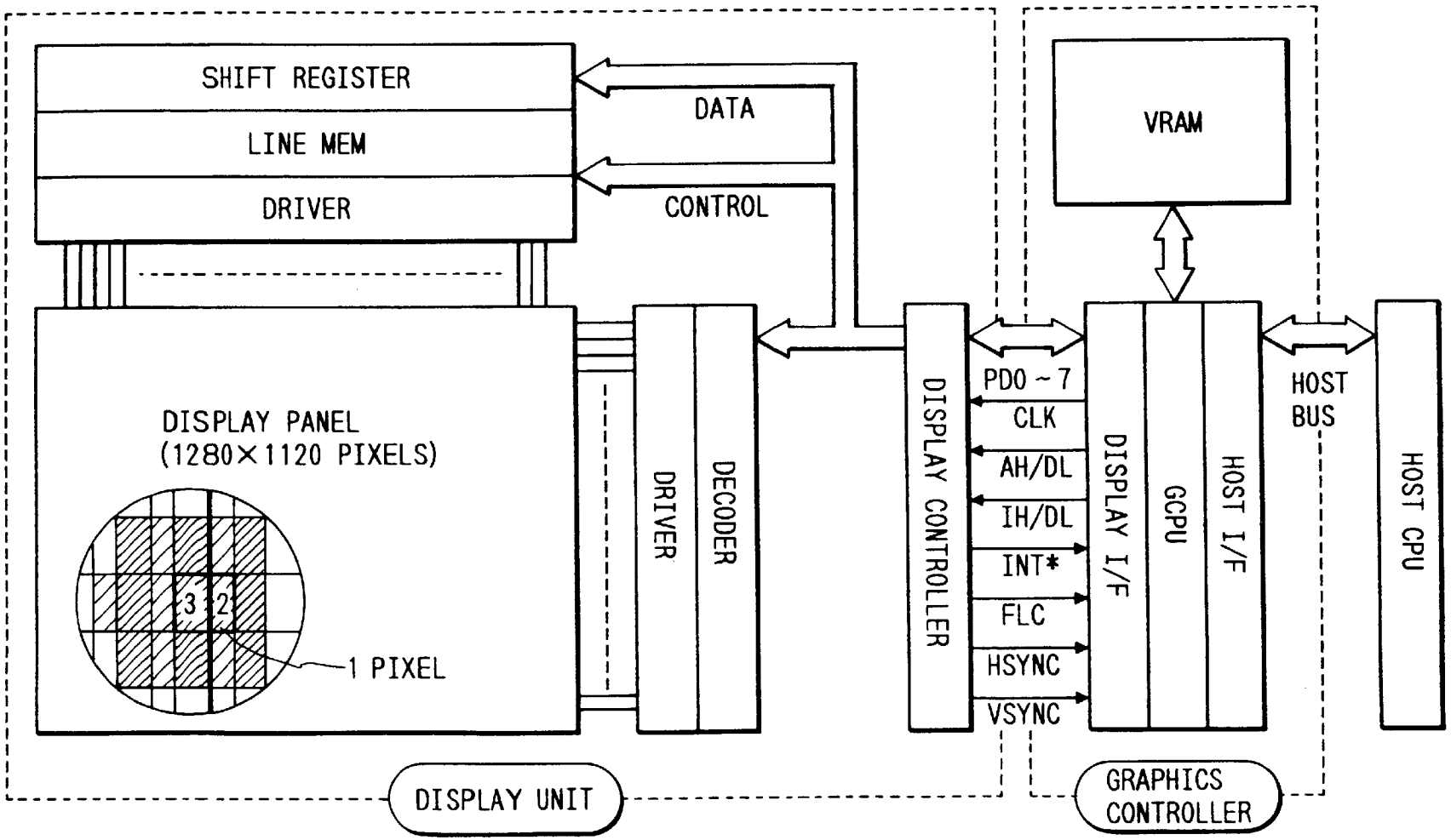
FIG. 2 is a whole constructional diagram of a graphics controller including the image information output circuit according to the invention and of a ferro-electric liquid crystal display panel unit.

FIG. 2 is an entire constructional diagram of a graphics controller provided on the side of a main body apparatus such as a personal computer or the like as a supply source of image information and a ferro-electric liquid crystal display apparatus. The image information output circuit according to the invention is provided in the graphics controller in FIG. 2.

The display panel is constructed by arranging 1024 scanning electrodes and 2560 information electrodes like a matrix and sealing a ferroelectric liquid crystal into a space between two glass plates which were subjected to an orientation process. Scanning lines are connected to a scanning electrode driving circuit. Information lines are connected to an information electrode driving circuit. One pixel has a construction of two bits/pixel in which one pixel is divided into portions having an area ratio of 3:2 as shown in ○ in the display panel in FIG. 2. The gradation display of four levels per pixel can be performed.

A display controller receives the display information from the image information output circuit according to the invention and controls the scanning electrode driving circuit and the information electrode driving circuit.

The graphics controller comprises a CPU (central processing unit, hereinafter, referred to as a GCPU) to control the whole display functions. A VRAM (image information storing memory). A display interface serves as an image information output circuit according to the invention. The graphics controller controls the management of the display information and the whole communication between a host CPU and the display apparatus.

Figure 1:
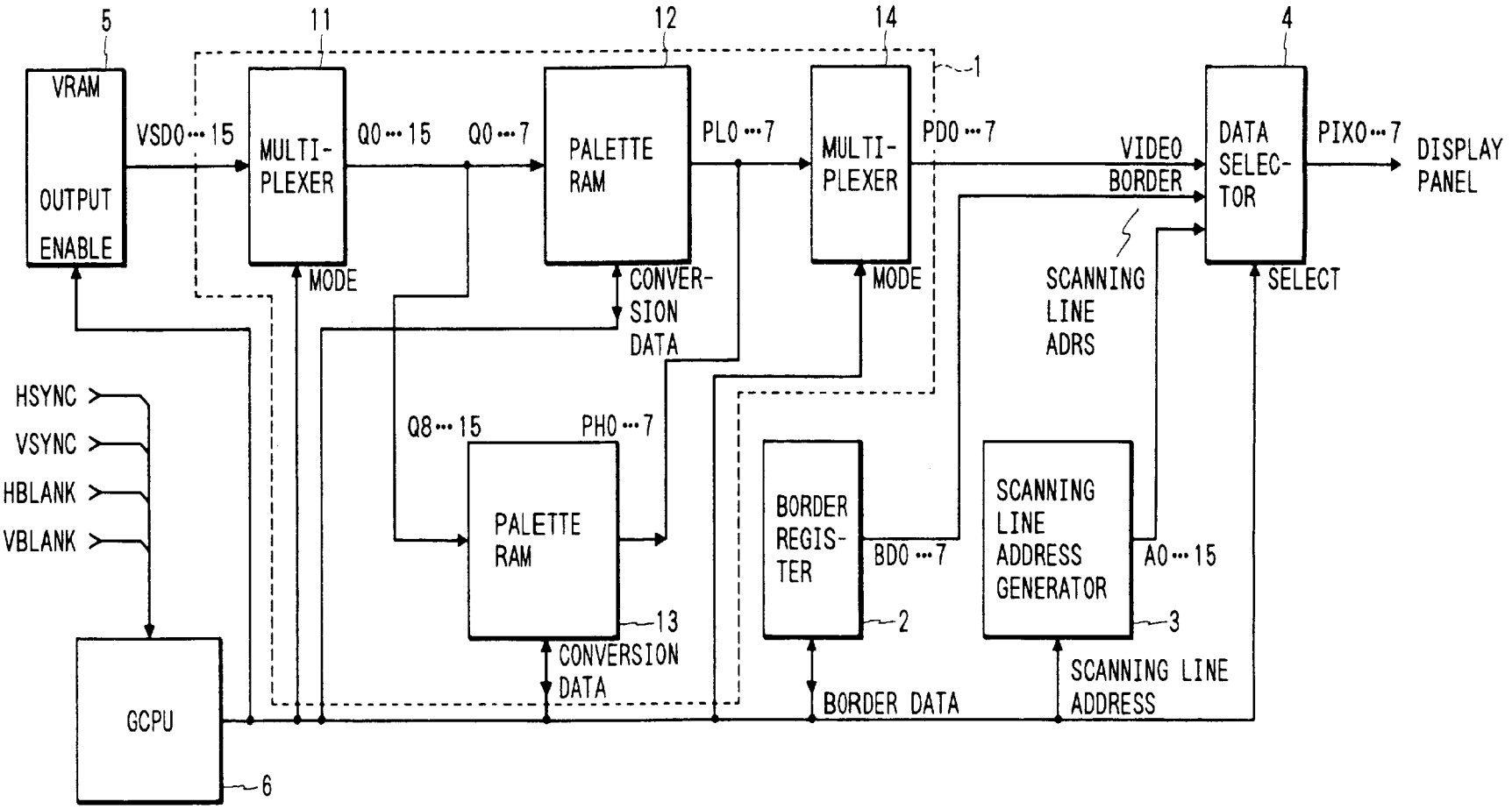
FIG. 1 is a constructional diagram of an image information output circuit according to the invention.

FIG. 1 is a constructional diagram of the display interface according to the invention. The display interface comprises a gradation conversion section 1 to convert image data from the VRAM into area gradation data. A border register 2 determines data in the portion out of an effective display area, and a scanning line address generator 3 is provided. A data selector 4 converts the image data into an output format to transfer the image data to the liquid crystal display apparatus. The operation will now be described hereinbelow with reference to the drawings.

(1) Gradation conversion section

When explaining the display modes under the graphics environment of the personal computer made by IBM Corporation as an example, the number of constructing bits per pixel of the image data stored in a VRAM 5 differs every display mode in a manner such that it is set to 4 bits/pixel in the mode 3(h) and is set to 8 bits/pixel in the mode 13(h). In the embodiment, data of two bytes (16 bits) in the image data stored in the VRAM 5 is always output by a single reading operation (access) for the VRAM 5. Therefore, the number of pixels which are output by a single access to the VRAM 5 differs depending on the display mode. For instance, the image data of four pixels is output in the case of the mode 3(h) by the single access. The image data of two pixels is output in the case of the mode 13(h) by the single access. Since a palette RAM 12, which will be explained hereinlater, executes a gradation conversion on a pixel unit basis, the image data which was read out of the VRAM 5 must be transmitted to the palette RAM 12 on a pixel unit basis.

A pixel multiplexer 11 is provided for this purpose. FIG. 3 shows an image data conversion format of the pixel multiplexer 11. The conversion modes are switched by a command from a GCPU 6 (FIG. 2). For instance, in the display mode 3(h), the image data of four pixels is output from the VRAM 5 by the single access. Therefore, the pixel multiplexer 11 is operated in a conversion mode B. In the conversion mode B, the pixel multiplexer 11 extracts the data of two pixels of $VSD_0$ to $VSD_3$ and $VSD_4$ to $VSD_7$ at the first phase from $VSD_0$ to $VSD_{15}$ including data of four pixels which are output from the VRAM 5 and leads as $Q_0$ to $Q_3$ and $Q_8$ to $Q_{11}$ to the palette RAM 12 and a palette RAM 13, respectively. Then, at the second phase, the data of two pixels of $VSD_8$ to $VSD_{11}$ and $VSD_{12}$ to $VSD_{15}$ are transmitted to the palette RAMs 12 and 13 as $Q_0$ to $Q_3$ and $Q_8$ to $Q_{11}$, respectively. As mentioned above, the pixel multiplexer 11 separately leads the image data to the palette RAMs 12 and 13 at two phases. On the other hand, in FIG. 3, conversion modes A and C correspond to the cases where the image data format in the VRAM is set to 8 bits/pixel and 2 bits/pixel, respectively. In a manner similar to the case of the above 4 bits/pixel, the image data is led to the palette RAM 12 on a pixel unit basis.

The palette RAMs 12 and 13 correspond to a portion for converting the pixel data (color information) from the VRAM 5 into the ON/OFF data of the pixels of the actual display panel on a unit pixel basis, respectively. The conversion from <color information in the depth direction> into <gradation information in the lateral direction> (area gradation) according to the invention is realized in the above portion. In the embodiment of FIG. 1, two palette RAMs have been arranged in parallel as a countermeasure for a point that the image data conversion rate in the palette RAM is slower than a required transfer rate to the display apparatus. If a processing speed of the palette RAM is sufficiently high, no problem occurs even when only one palette RAM is used. On the contrary, in the case where a reading speed from the VRAM 5 or operating speeds of the multiplexers 11 and 14 are enough high, by increasing the number of palette RAMs, the processing speed of the conversion system can be raised in correspondence to it.

Each of the palette RAMs 12 and 13 is constructed by 256 registers having a length of eight bits which are called palette registers. The gradation information (ON/OFF data of the pixels) corresponding to the color information of the pixels is previously written by the GCPU 6. In the embodiment, the same gradation information is written into the palette RAMs 12 and 13. Although the writing and reading operations for each palette RAM can be executed at arbitrary timings, they are ordinarily performed as necessary every horizontal or vertical scanning period.

Figure 4A:
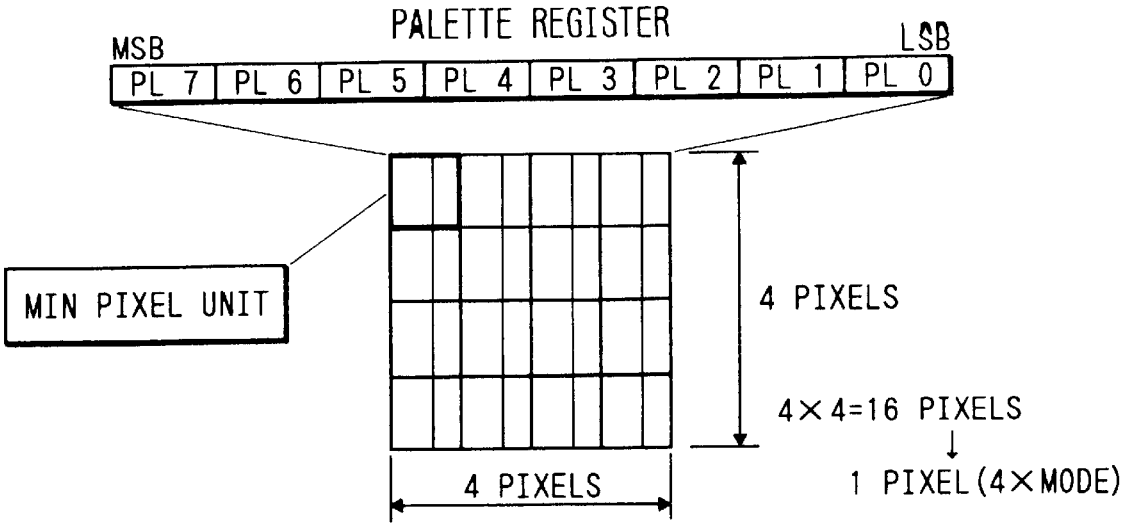
FIGS. 4A to 4C are diagrams each showing the relation between the gradation data of a palette register in a palette RAM and the arrangement of the pixels of an actual display panel.
Figure 4B:
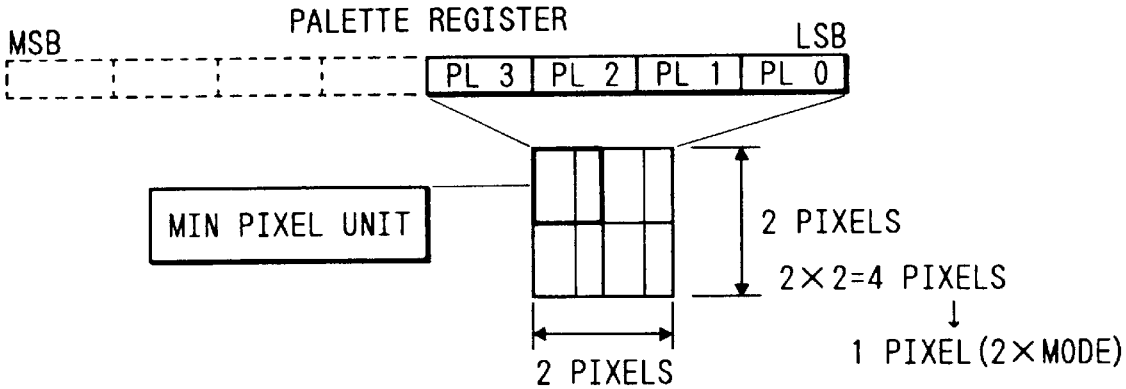
Figure 4C:
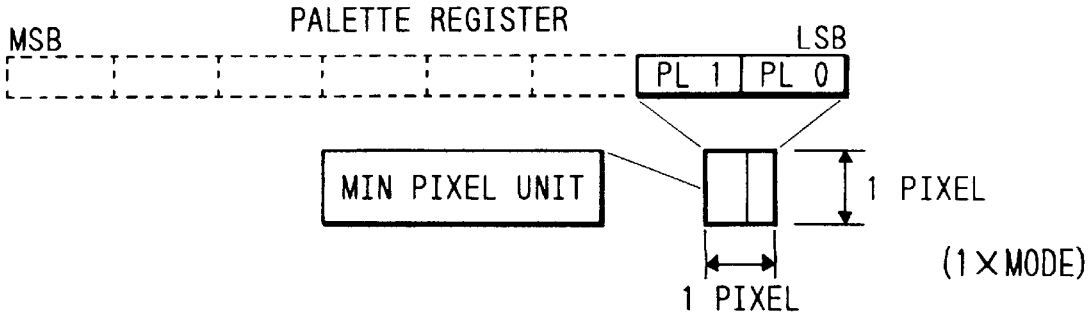

FIGS. 4A to 4C are diagrams each showing the relation between the gradation data (ON/OFF data of pixels) of the palette register in the palette RAM and the arrangement of the pixels of the actual display panel. FIG. 4C shows the minimum pixel unit of the display panel used in the embodiment. As mentioned above, one pixel is divided into portions at an area ratio of 3:2 and the gradation display of four levels is realized by respectively independently driving the two portions. Each of FIGS. 4B and 4A shows a handling of one pixel in the enlarged display mode. By handling four pixels and sixteen pixels as one pixel in a group, respectively, the enlarged display of two times and four times can be realized. The number of gradations which can be displayed also increases to 8 levels and 16 levels. As shown in FIGS. 4A to 4C, the gradation data of the palette register corresponds to the ON/OFF data of each pixel on the display panel at a ratio of 1:1.

Figure 5A:
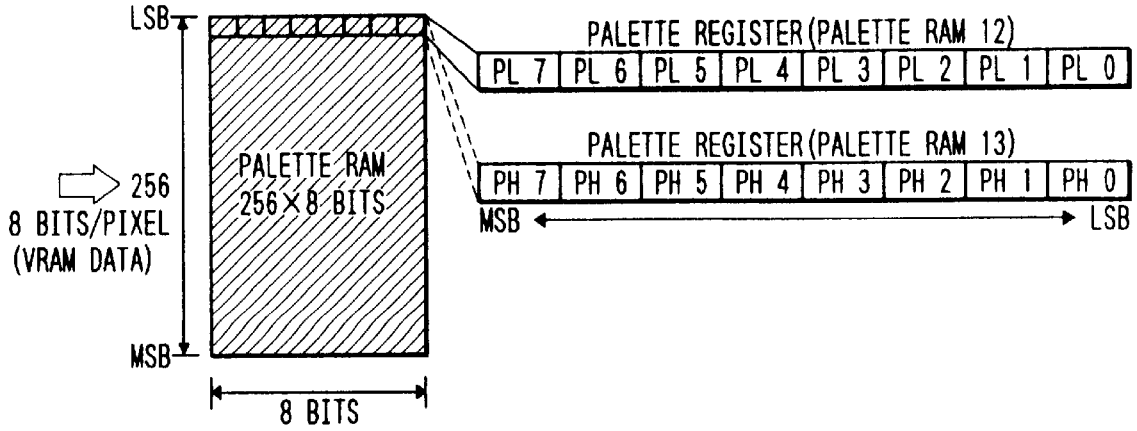
FIGS. 5A to 5C are diagrams each showing the relation between the image data from a VRAM and the addresses of a palette register.
Figure 5B:
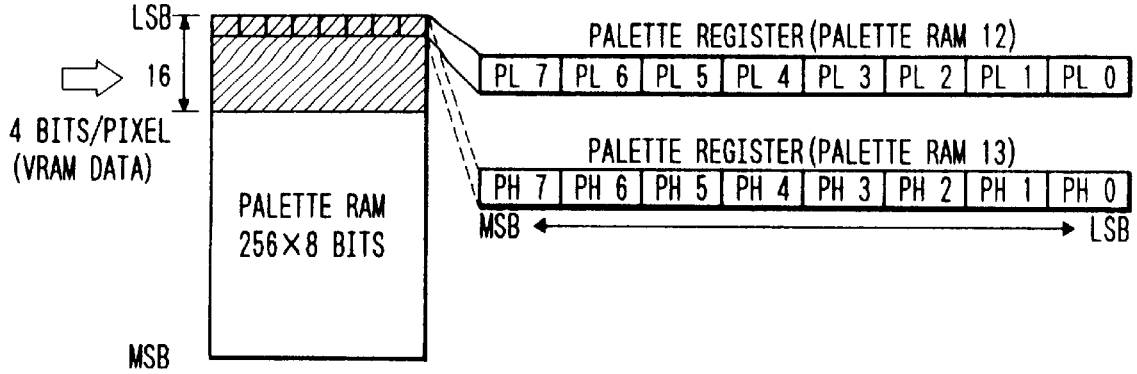
Figure 5C:
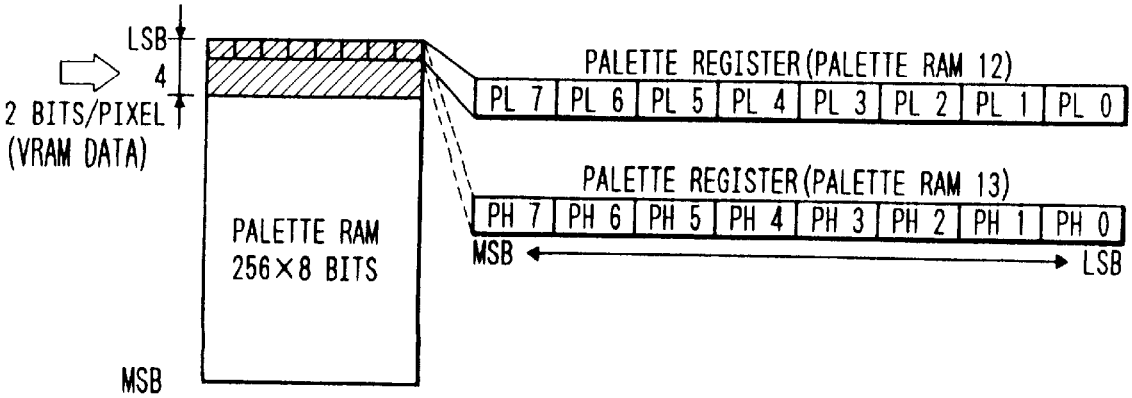

As shown in FIGS. 5A to 5C, the pixel data (color information) from the VRAM 5 functions as an address to select the palette register in the palette RAM. For instance, in the case where the pixel data (color information) from the VRAM 5 relates to 4 bits/pixel, one of the 16 palette registers is selected. On the other hand, in the case where the pixel data relates to 8 bits/pixel and 2 bits/pixel, one of the 256 palette registers and one of the 4 palette registers are selected. When a certain palette register is selected, the gradation data $PL_0$ to $PL_7$ and $PH_0$ to $PH_7$ stored therein are output and are led to the pixel multiplexer 14 at the next stage.

The pixel multiplexer 14 executes a process to convert the ON/OFF data (data of at most eight bits) of the pixel which is output from the palette RAM into the number of bits which can be displayed in accordance with the enlarged display mode (e.g., 1×, 2×, 4×) of the display panel.

FIG. 6 shows conversion modes of the pixel multiplexer 14. For instance, a conversion mode B is selected in the case of executing the enlarged display of two times (2×) by the display panel. At this time, since the number of the gradation data which can be obtained per pixel is equal to four bits, only four lower bits ($PL_0$ to $PL_3$; $PH_0$ to $PH_3$) are extracted from the 8-bit data $PL_0$ to $PL_7$ and $PH_0$ to $PH_7$ which are output from the palette RAMs 12 and 13, respectively. The extracted eight bits are output as $PIX_0$ to $PIX_7$. On the other hand, conversion modes A and C show conversion formats in the enlarged display mode of four times (4×) and in the equal magnification mode (1×), respectively.

As described above, the pixel data (color information) in the VRAM 5 is converted into the gradation data on the display panel by the two multiplexers 11 and 14 and the palette RAMs.

(2) Border Register Section

Figure 7:
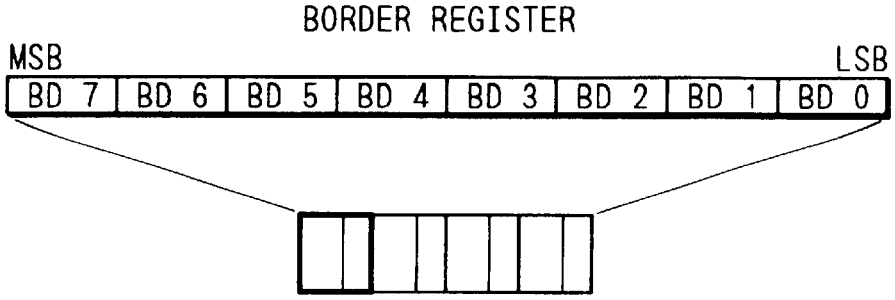
FIG. 7 is a diagram showing a construction of a border register and examples of border data and a display pattern.
Figure 7:
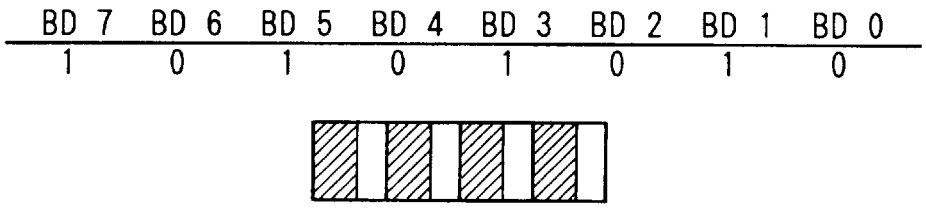
Figure 7:
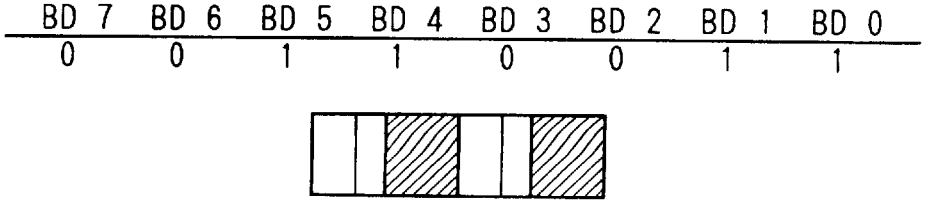
Figure 8:
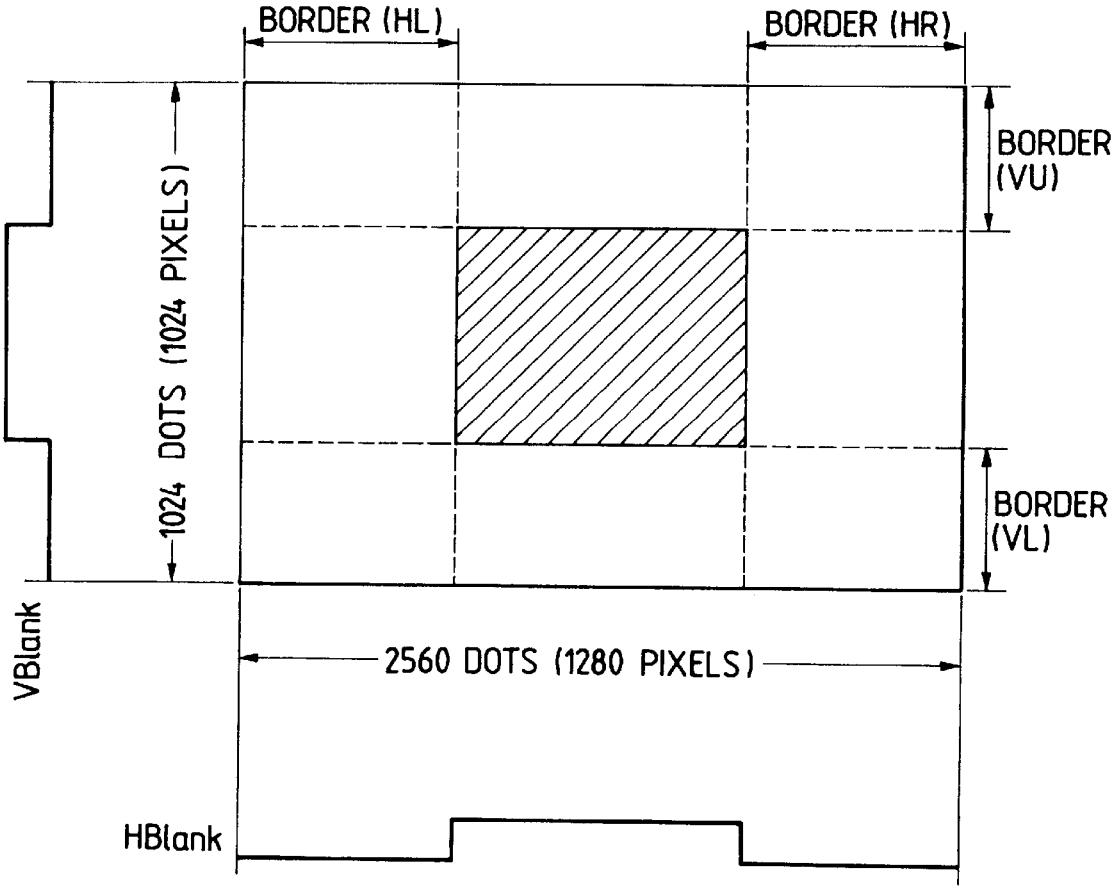
FIG. 8 is a diagram showing the relation between the position of a border portion on a display screen and the horizontal and vertical blanking signals.

As mentioned above, in the case where the number of effective pixels of the liquid crystal display apparatus is larger than the resolution of the display mode, some pattern must be displayed in the redundant pixels (border portion) out of the effective display area. The border register 2 has been provided to store data which is output to the border portion. FIG. 7 shows a construction of a border register. In the embodiment, the border register fundamentally comprises one register having a length of eight bits and the eight bits correspond to border data $BD_0$ to $BD_7$ (FIG. 7), respectively. On the other hand, the border register 2 has a construction of what is called a double buffer. Data in the border register 2 can be rewritten at an arbitrary timing from the GCPU 6. The actual border data is set into a border register output stage at a timing of a horizontal or vertical sync signal. A timing to transmit the data set in the border register 2 is controlled by horizontal and vertical blanking signals (HBlank and VBlank). Fundamentally, as shown in FIG. 8, border data is output when either one of the horizontal and vertical blanking signals is set to the Lo (low) level (in the blanking period). Image data in the effective display area is output in a period of time other than the blanking period. An explanation will be made in detail in conjunction with the operation of a data selector, which will be explained hereinlater.

(3) Scanning Line Address Data Generator

The scanning line address generator 3 has been provided to generate scanning line address data $A_0$ to $A_{15}$ of the display panel. The generator 3 comprises a 12-bit binary counter (up to 4096 scanning lines can be selected) which uses as clocks a horizontal sync signal Hsync which is input from the display controller on the liquid crystal display apparatus side. The counter can preset a count value (scanning line address data) from the GCPU 6 at an arbitrary timing. Further, a count-up width (how many scanning lines should be jumped and scanned) can be also set.

(4) Output Section to the Liquid Crystal Display Apparatus

The image data transfer formats to the ferro-electric liquid crystal display apparatus have already been proposed by the same applicant as the present invention in Japanese Patent Application Nos. 61-212184, 63-285141, and the like with respect to a communicating method to realize a high resolution display in a display element having a memory performance. According to the above propositions, with respect to the transfer of image data, there is used a method whereby the scanning line address information and the image information are serially time-sharingly transferred on the same transmission line for the scanning lines which need to be rewritten.

The data selector 4 has been provided to realize those transfer formats. The data selector 4 time-sharingly switches three kinds of data such as image data $PD_0$ to $PD_7$ which were subjected to the gradation conversion, border data $BD_0$ to $BD_7$, and scanning line address data $A_0$ to $A_{15}$ on the basis of timing control signals from the GCPU 6 and sends the switched data to the display apparatus.

Figure 9:
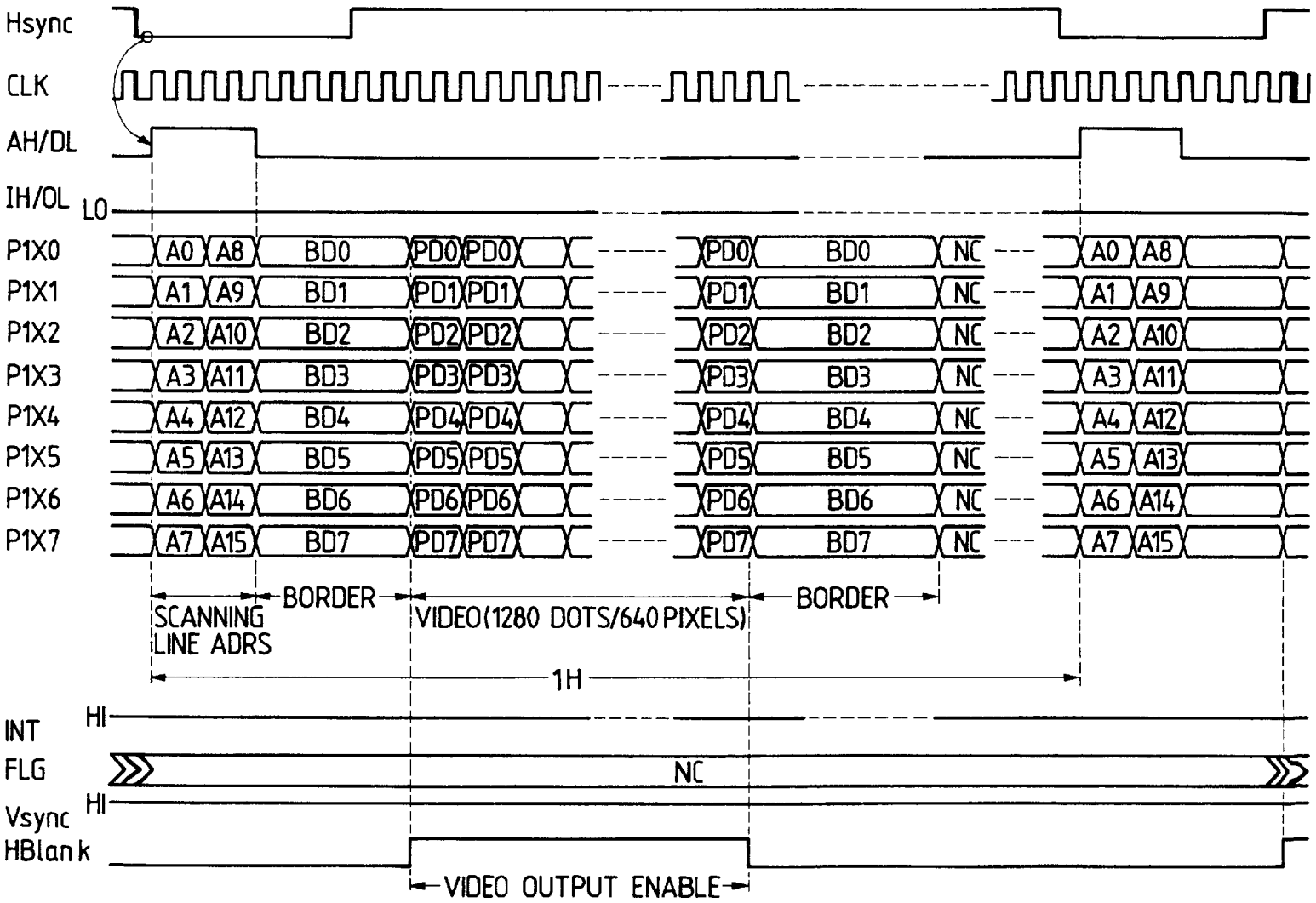
FIG. 9 is a diagram showing an example of a transfer format from an image information output circuit according to the invention.

FIG. 9 shows an example of a transfer format from the display interface serving as an image information output circuit according to the invention which conforms with the methods of the above propositions. In FIG. 9, when the horizontal sync signal Hsync is input for a period of time when the horizontal blanking signal HBlank is set to the Lo level (in the blanking period), the data selector 4 first outputs the scanning line address data $A_0$ to $A_{15}$ by two cycles (four clocks (CLK)) by the timing control from the GCPU 6. Then, the border data $BD_0$ to $BD_7$ from the border register 2 are continuously transmitted onto communication lines $PIX_0$ to $PIX_7$ for period of time until the HBlank is set to the Hi (high) level. When the HBland is set to the Hi level (after completion of the blanking period), the image data $PD_0$ to $PD_7$ in the effective display area which were subjected to the gradation conversion are transmitted onto the communication lines $PIX_0$ to $PIX_7$. In FIG. 9, when the information of 640 pixels (1280 dots/640 pixels) has been transferred as image data in the effective display area, the GCPU 6 again sets the HBlank to the Lo level. When the HBlank is set to the Lo level, the data selector 14 again allows the border data $BD_0$ to $BD_7$ to be transmitted onto the communication lines $PIX_0$ to $PIX_7$ and finishes the transfer of the data (640 pixels) of all of the pixels.

FIG. 9 shows transfer timings in the horizontal scanning direction. The data selector 4 also similarly distinguishes the border area and the effective display area by using the vertical blanking signal with respect to the vertical scanning direction and switches the output data.

Further, by controlling the timings of the HBlank and VBlank, the effective display area can be also displayed at an arbitrary position on the display screen.

As described above, in the display apparatus using the ferroelectric liquid crystal or the like having the bistability (memory performance), there is provided an image information output circuit having: a first multiplexer to lead image data which is read out of an image memory to the next stage every pixel; palette RAMs for outputting ON/OFF data of predetermined pixels on the basis of data which is output from the first multiplexer; and a second multiplexer to convert the data from the palette RAMs into an output format to transfer it to a display apparatus. The converting process of the image data and the process of an area (frame portion) out of the effective display area are executed in accordance with a display mode request from a main body CPU. Thus, display screens in various display modes which have conventionally been used in a CRT or the like can be displayed on the display apparatus using a binary display element such as a ferroelectric liquid crystal display apparatus or the like without losing the image.

We claim:

1. A display apparatus for displaying image data in a plurality of display modes respectively having different numbers of display pixels in longitudinal and lateral directions display mode by display mode, said display apparatus comprising:

a display panel having a l1×l2 pixel units, where l1 denotes the number of the lateral display pixels and l2 denotes the number of longitudinal display pixels, l1 and l2 being positive numbers;

selection means for selecting one of the plurality of display modes, the number of the display pixels in the selected one display mode being m1×m2. where m1 denotes the number of the lateral display pixels, m2 denotes the longitudinal display pixels, m1 and m2 being positive numbers;

memory means for storing image data having the m1×m2 pixels of the one display mode selected by said selection means;

pixel data output means for outputting the image data stored in said memory means pixel data by pixel data;

magnification determination means for determining a magnification n, where n is a positive number, based on the l1, l2, m1 and m2;

changing means for changing the number of pixel units forming each one of the display pixels of the image data output by said pixel data output means to n×n; and display control means for controlling said display panel based on the image data with the number of pixel units changed by said changing means to display the image data of the m1×m2 display pixels as the image data of the (n×m1)×(n×m2) display pixels.

2. A display apparatus according to claim 1, wherein the pixel data output means comprises a multiplexer.

3. A display apparatus according to claim 1, wherein said display data output means comprises a random access memory (RAM) in which binary data has been stored.

4. A display apparatus according to claim 1, wherein said display data output means comprises a plurality of random access memories (RAMs) in each of which binary data has been stored.

5. A display apparatus according to claim 1, further comprising frame display means for displaying desired frame image data at an area out of an effective display area of the image data displayed on the display panel.

6. A display apparatus according to claim 5, wherein said frame display means outputs and displays the frame image data of the area out of the effective display within horizontal and vertical blanking periods of time of the image data which is displayed in the effective display area.

7. A display apparatus according to claim 1, wherein said display data output means comprises a multiplexer.

8. A display apparatus according to claim 1, wherein the liquid crystal having the memory performance comprises a ferroelectric liquid crystal.

9. An apparatus according to claim 1, wherein said liquid crystal comprises a ferroelectric liquid crystal.

10. A display apparatus comprising:

a display panel comprising a liquid crystal and having a number of pixel units;

magnification determination means for determining a magnification of the number of the display pixels based on the number of display pixels and the number of pixel units;

magnifying means for magnifying the number of display pixels of the image data by the magnification determined by said magnification determination means;

frame display control means for displaying the frame image data at an area outside of an effective display area comprising the pixel units of the number determined by the display pixels of the magnified number; and transfer means for transferring the magnified image data to be displayed on the effective display area by a display line unit, wherein said transfer means transfers the frame image data within a blanking period of a synchronous signal for transferring the image data to each display line, wherein said frame display control means outputs the frame image data and/or address data corresponding thereto and displays the frame image data within horizontal and/or vertical blanking periods of time of the magnified image data at a position designated by the address data and wherein said frame display control means writes the frame image data of the area outside of the effective display area within one horizontal scanning period or one vertical display period of time of the magnified image data.

11. A display apparatus according to claim 9, wherein said frame display controller further has memory means for storing the frame image data which is displayed to the area out of the effective display area.

12. An apparatus according to claim 10, wherein said liquid crystal comprises a ferroelectric liquid crystal.

13. A method of displaying image data on a display apparatus comprising a display panel having $l1 \times l2$ pixel units, where $l1$ denotes the number of the lateral display pixels and $l2$ denotes the number of longitudinal display pixels, $l1$ and $l2$ being positive numbers and for displaying image data in a plurality of display modes respectively having different numbers of display pixels in longitudinal and lateral directions display mode by display mode, said method comprising the steps of:

selecting one of the plurality of display modes, the number of the display pixels in the selected one display mode being $m1 \times m2$, where $m1$ denotes the number of the lateral display pixels, $m2$ denotes the longitudinal display pixels, $m1$ and $m2$ being positive numbers;

storing image data having the $m1 \times m2$ pixels of the one display mode selected at said selection step;

outputting the stored image data pixel data by pixel data;

determining a magnification n, where n is a positive number, based on the $l1$, $l2$, $m1$ and $m2$;

changing the number of pixel units forming each one of the display pixels of the image data output by said outputting step to $n \times n$; and controlling the display panel based on the image data with the number of pixel units changed at said changing step to display the image data of the $m1 \times m2$ display pixels as the image data of the $(n \times m1) \times (n \times m2)$ display pixels.

14. A method of displaying frame image data at an area outside of an effective display area for displaying image data of a display panel including a liquid crystal and having a number of pixel units, said method comprising the steps of:

storing image data having a number of display pixels and frame image data;

determining a magnification of the number of display pixels based on the number of display pixels and the number of pixel units;

magnifying the number of display pixels of the image data by the magnification determined by said determining step;

displaying the frame image data at an area outside of the effective display area comprising the pixel units of the number determined by the display pixels of the magnified number; and transferring the magnified image data to be displayed on the effective display area by a display line unit, wherein said transferring step transfers the frame image data within a blanking period of a synchronous signal for transferring the image data to each display line, wherein at said displaying step, the apparatus is controlled to output the frame image data and/or address data corresponding thereto and display the frame image data within horizontal and/or vertical blanking periods of time of the magnified image data at a position designated by the address data and wherein said displaying step writes the frame image data of the area outside of the effective display area within one horizontal scanning period or one vertical display period of time of the magnified image data.

* * * * *

UNITED STATES PATENT AND TRADEMARK OFFICE

CERTIFICATE OF CORRECTION

PATENT NO. : 6,124,842
DATED : September 26, 2000
INVENTOR(S) : Atsushi Mizutome et al.

It is certified that error appears in the above-identified patent and that said Letters Patent is hereby corrected as shown below:

Title page, Item [56] OTHER PUBLICATIONS
"Abs. vol." should read -- Abs. Jp. vol. --.

Column 1,
Line 18, "displays of" should read -- displays for --;
Line 22, "example for" should read -- example of --.
Line 49, "256" -- not bold.

Column 3,
Line 46, "ferro-electric" should read -- ferroelectric --.

Column 4,
Line 9, "ferro-electric" should read -- ferroelectric --.

Column 5,
Line 36, "enough high," should read -- high enough, --;
Line 39, "256" -- not bold.

Column 7,
Line 2, "ferro-electric" should read -- ferroelectric --;
Line 32, "for period" should read -- for a period --;
Line 33, "HBland" should read -- HBlank --.

Column 9,
Line 25, "claim 9," should read -- claim 10, --;

Signed and Sealed this

Twenty-third Day of October, 2001

*Attest:*

Nicholas P. Godici

*Attesting Officer*

NICHOLAS P. GODICI
*Acting Director of the United States Patent and Trademark Office*